US005706623A

United States Patent [19]

Brown

[11] Patent Number: 5,706,623

[45] Date of Patent: Jan. 13, 1998

[54] CARPET EDGE STRIP

[75] Inventor: William R. Brown, Mission, Kans.

[73] Assignee: Mono Track Systems, Inc., Mission, Kans.

[21] Appl. No.: 778,404

[22] Filed: Jan. 2, 1997

[51] Int. Cl.[6] ..... F04F 11/16; E04F 15/02

[52] U.S. Cl. ..... 52/718.04; 52/179

[58] Field of Search ..... 52/174, 179, 716.1, 52/716.3, 716.8, 717.05, 717.06, 718.01, 718.04; 108/27; 312/140.3, 140.4

[56] References Cited

U.S. PATENT DOCUMENTS

| | | | |
|---|---|---|---|
| 2,487,571 | 11/1949 | Maxwell | 52/718.04 |
| 3,408,250 | 10/1968 | Finefrock | 52/717.05 |
| 3,841,195 | 10/1974 | Jureit | 85/13 |
| 4,321,294 | 3/1982 | Naka | 52/179 |
| 4,545,170 | 10/1985 | Shirey | 52/670 |
| 4,730,432 | 3/1988 | Schafer et al. | 52/716 |
| 4,788,760 | 12/1988 | Schafer et al. | 29/278 |
| 4,893,449 | 1/1990 | Kemper | 52/717.06 |

OTHER PUBLICATIONS

Double rib strip extrusion, manufacturer unknown. First seen by applicant approximately Oct. 26, 1996.

*Primary Examiner*—Michael Safavi
*Attorney, Agent, or Firm*—Wm. Bruce Day

[57] ABSTRACT

A carpet edge strip secures a carpet edge to the floor and is formed of an aluminum extrusion in the form of a substantially flat strip attached to the floor and with an upstanding rib protruding therefrom. A cap molding fits over the carpet edge strip and has a nose portion, a central slot or groove and a tail portion with the slot or groove tightly receiving the strip upstanding rib. The nose portion fits down against the strip on one side and the tail portion extends over the carpet edge on the other side, squeezing the carpet edge between the carpet edge strip and the cap to prevent the edge from coming loose and to provide a pleasing, finished appearance.

5 Claims, 1 Drawing Sheet

CARPET EDGE STRIP

FIELD OF THE INVENTION

This invention relates to molding tracks in general and in particular to molding tracks or strips for holding down carpet edges.

BACKGROUND OF THE INVENTION

Carpet edges normally need some type of molding or attachment strip to hold the edge down. Around the perimeter of room walls, normally a tack strip is used and at door openings, such as from a living room or dining room into a kitchen where the carpeting is to end, ornamental or pleasingly appearing molding strips must be used. These are often in the form of extruded aluminum with a quarter round shape and the flat part where the carpet edge attaches is formed with prongs or other gripping holders to secure the carpet edge. None of these are particularly pleasing in appearance, as the aluminum becomes scratched, anodized coloring wears off or otherwise does not present a pleasing appearance. The present invention is designed to alleviate the above-mentioned problems and includes a carpet edge strip generally in the form of an elongate, substantially flat strip having a bottom surface for mounting upon a floor and an upper surface having at least one land section and an upstanding rib. An elongate cap molding, such as of wood, includes a tail portion and a nose portion, the nose portion having a slot or groove for engagement about the rib and for covering the strip. A carpet edge is laid into the strip land section and covered by the cap molding tail portion. The cap molding nose portion provides a front edge to the carpet edge strip and is generally curved to provide a pleasing appearance. The nose portion terminates flush with the edge strip or may extend therebelow a slight distance, as would be appropriate for use where there is a difference in level of adjoining floor surfaces.

OBJECTS OF THE INVENTION

The objects of the present invention are to provide a carpet edge strip which secures a carpet edge to a floor surface; to provide such a carpet edge strip to which a cap molding can be affixed for presenting a finished appearance; to provide such a cap molding to which a wood edge strip can be affixed and to provide such a carpet edge strip which is inexpensive to manufacture and easy to use.

Other objects and advantages of this invention will become apparent from the following description taken in connection with the drawings illustrating preferred and alternate embodiments of the invention.

DESCRIPTION OF THE PREFERRED AND ALTERNATE EMBODIMENTS

As required, detailed embodiments of the present invention are disclosed herein. However, the invention is not to be limited to the specific terms and configurations thereof except as set forth in the appended claims. The drawings and detailed description are only exemplary and the invention may be embodied in various forms.

Figure 1:
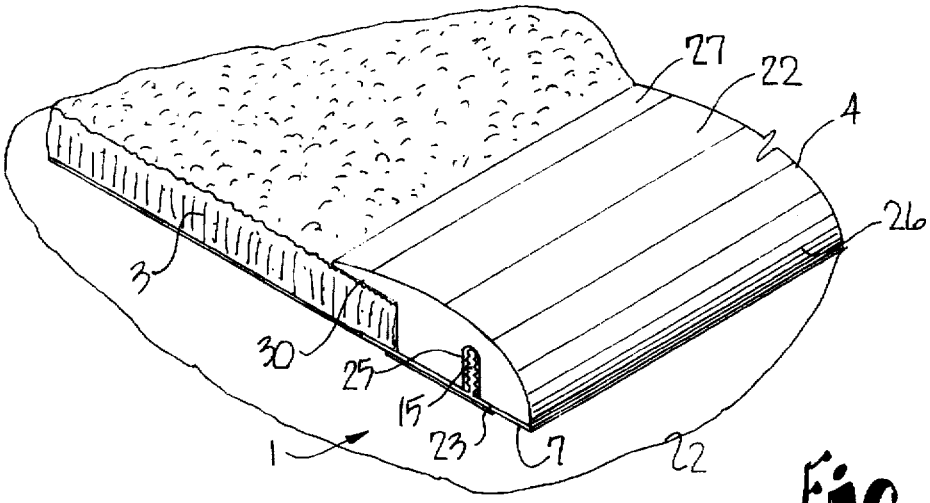
FIG. 1 is a perspective view of a carpet edge strip embodying the present invention and shown in connection with a carpet section and a cap molding.

The reference numeral 1, FIG. 1, generally indicates a carpet edge strip embodying the present invention. The carpet edge strip 1 is shown attached to a floor surface 2 and protecting an otherwise exposed edge of a carpet section 3. The carpet edge trip 1 is covered by a cap molding 4 to provide a pleasing and finished appearance.

Figure 2:
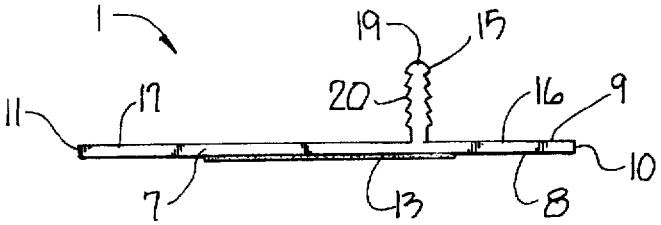
FIG. 2 is a side elevational view of the carpet edge strip.

In more detail, the carpet edge strip 1, FIG. 2, is an elongate, substantially flat strip 7 such as extruded aluminum with bottom and upper surfaces 8 and 9 and opposite front and rear edges 10 and 11. Attachment means extend from the bottom surface 8 and in the illustrated example include an adhesive tape 13 for attachment to the floor surface 2, although other attachment means such as arrays of prongs or fastener holes may be used as desired. Use of the adhesive tape 13 is preferred, as it enables easy placement and relative ease of removal should it be necessary. A single upstanding rib 15 protrudes upwardly from the strip upper surface 9 and is preferably positioned about one-third of the distance between the front edge 10 and the rear edge 11, thereby dividing the strip upper surface 9 into spaced front and rear land sections 16 and 17. The rib 15 projects upwardly a short distance, such as 5/16ths inch and includes a curved top apex 19 and a plurality of longitudinally extending teeth 20 which project angularly downwardly, or in a reverse angle, so as to inhibit disengagement of the cap molding 4 when emplaced thereon.

Referring to FIG. 1, the cap molding 4 is mounted on the carpet edge strip 1 and preferably consists of a molded decorative strip having a curved top surface 22 and a flat bottom surface 23 for lying flat against the strip upper surface 9. A groove or channel 25 extends the length of the cap molding 4 inwardly from the bottom surface 23 and is sized appropriately to the strip upstanding rib 15 so that there is a tight interference fit. As shown in FIG. 1, the cap molding 4 has a curved nose section 26 and a tapered tail section 27 which leaves a horizontal slot 30 between the tail section 27 and the rear land section 17 for covering the edge portion of the carpet section 3. Note that the rear land section 17 may contain sticky tape or adhesives may be applied to the carpet edge to hold it in the horizontal slot 13.

Figure 3:
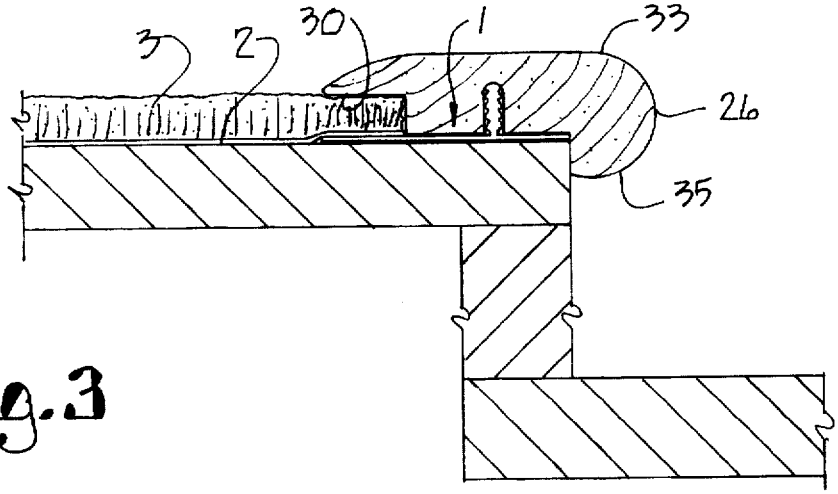
FIG. 3 is a fragmentary side elevational view of a carpet edge strip, carpet section and alternative embodiment of a cap molding.

An alternative design is shown in connection with FIG. 3 wherein only the cap molding 4 is different. The cap molding 33, FIG. 3, includes an overhanging lip 35 in the nose section 26 so as to extend beyond the front edge 10 and downwardly therefrom as to cover a break in elevation from one floor surface 2 to another.

Use of the carpet edge strip 1 in either the embodiments shown in FIGS. 1 and 2 or the alternative embodiment shown in connection with FIG. 3 is quick and easy and involves cutting the carpet edge strip 1 to length and applying it to the desired location on the floor surface 2, as by use of the tape 13 or other adhesive or mounting means. The carpet section 3 is cut to shape and the carpet edge laid down so as to slightly overlap the rear land section 17 on the strip 1 and then the cap molding 4 positioned so that the molding groove 25 is positioned over the rib 15 and the cap molding 4 pressed downwardly until it bottoms out. Thus the cap molding 4 is a press fit on the carpet edge strip 1 and does not need to be separately glued, screwed or otherwise affixed to form the completed decorative carpet edge protective structure.

Although various embodiments of this invention have been illustrated and described, it is not to be so limited except as set forth in the following drawings.

What is claimed and desired to be secured by Letters Patent is as follows:

1. A carpet edge strip for securing and covering a carpet edge and comprising an elongate, substantially flat strip having a bottom surface for mounting upon a floor and an upper surface having at least one land section and a single upstanding rib whereby a carpet edge may be laid into said land section and at least partially covered by a cap molding engaging said rib said rib having a plurality of longitudinally extending teeth on both sides thereof which are downwardly angled for inhibiting disengagement of said cap molding from said strip.

2. A combination carpet edge strip and cover for securing a carpet edge and comprising an elongate, substantially flat strip having a bottom surface for mounting upon a floor and an upper surface having at least one land section and a single upstanding rib; and an elongate cap molding including a tail portion and a nose portion, the nose portion having a slot therein engaged about said rib and covering said strip; whereby said carpet edge may be laid onto said strip land section and covered by said cap molding tail portion, said rib having a plurality of longitudinally extending teeth on both sides thereof which are downwardly angled for inhibiting disengagement of said cap molding from said strip.

3. A combination carpet edge strip and cover for securing a carpet edge, comprising an elongate, substantially flat extruded strip having a flat bottom for attachment to a floor and an upper surface having first and second land sections separated by a single substantially medially positioned upstanding rib; and an elongate cap molding fitting over the strip and including a tail portion and a nose portion, the nose portion having a longitudinal slot therein engaged about said rib with said tail portion covering said strip first land section and any carpet edge which laid therebetween and said nose portion covering said second land section for protection of said carpet edge which may be laid therebetween, said rib having a plurality of longitudinally extending teeth on both sides thereof which are downwardly angled for inhibiting disengagement of said cap molding from said strip.

4. The carpet edge strip set forth in claims 1, 2 or 3 including an adhesive strip attached to said flat bottom for adhesively affixing said carpet edge strip to said floor.

5. The carpet edge strip set forth in claims 1, 2 or 3 wherein said strip is of extruded aluminum.

* * * * *